US006092749A

United States Patent [19]

Stegmeier

[11] Patent Number: 6,092,749

[45] Date of Patent: Jul. 25, 2000

[54] DUAL MOTOR DRIVE SYSTEM

[76] Inventor: Bill Stegmeier, 27116 Grummand Ave., Tea, S. Dak. 57064

[21] Appl. No.: 09/204,491

[22] Filed: Dec. 3, 1998

[51] Int. Cl.[7] ..... B02C 4/42

[52] U.S. Cl. ..... 241/101.2; 241/159

[58] Field of Search ..... 241/159, 101.2

[56] References Cited

U.S. PATENT DOCUMENTS

| | | | |
|---|---|---|---|
| D. 287,017 | 12/1986 | Aldridge, Jr. . | |
| 4,044,958 | 8/1977 | Gutjahr . | |
| 4,098,029 | 7/1978 | Shiets . | |
| 4,432,245 | 2/1984 | Hattori et al. . | |
| 4,481,739 | 11/1984 | Suzuki et al. . | |
| 4,558,490 | 12/1985 | Hazenbroek et al. . | |
| 4,614,128 | 9/1986 | Fickler . | |
| 4,666,090 | 5/1987 | Ripani et al. | 241/101.2 |
| 4,760,668 | 8/1988 | Schlaefli . | |
| 4,803,390 | 2/1989 | Bertram et al. . | |
| 4,905,910 | 3/1990 | Wuestner | 241/101.2 |
| 5,042,645 | 8/1991 | Pritchard . | |
| 5,309,819 | 5/1994 | Ford . | |
| 5,580,006 | 12/1996 | Hennenfent et al. | 241/159 |

*Primary Examiner*—Mark Rosenbaum

[57] ABSTRACT

A new dual motor drive system for a roller grinder. The inventive device includes a roller grinder having top and bottom sets of rollers extending between the sides of the roller grinder. Each set of rollers has a front roller and a back roller. Each roller of each set of rollers has a shaft having a pair of opposite ends. A first pulley is coupled to the end of the front roller of the top set of rollers extending from the first side of the roller grinder. A second pulley is coupled to the end of the front roller of the bottom set of rollers extending from the first side of the roller grinder. A third pulley is coupled to the end of the back roller of the top set of rollers extending from the second side of the roller grinder. A fourth pulley is coupled to the end of the back roller of the bottom set of rollers extending from the second side of the roller grinder. First and second motors are provided each having a rotating shaft extending therefrom. A first belt is looped around the first pulley, the second pulley, and the rotating shaft of the first motor such that the first belt is arranged in a generally triangular configuration. A second belt is looped around the third pulley, the fourth pulley and the rotating shaft of the second motor such that the second belt is arranged in a generally triangular configuration.

12 Claims, 2 Drawing Sheets

DUAL MOTOR DRIVE SYSTEM

BACKGROUND OF THE INVENTION

1. Field of the Invention

The present invention relates to roller grinder drive systems and more particularly pertains to a new dual motor drive system for a roller grinder.

2. Description of the Prior Art

The use of roller grinder drive systems is known in the prior art. More specifically, roller grinder drive systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art roller grinder drive systems include U.S. Pat. No. 4,760,668; U.S. Pat. No. 5,042,645; U.S. Pat. No. 4,098,029; U.S. Pat. No. 4,481,739; U.S. Pat. No. 4,803,390; U.S. Pat. No. 4,044,958; U.S. Pat. No. 4,432,245; U.S. Pat. No. 4,558,490; U.S. Pat. No. 5,309,819; U.S. Pat. No. 4,614,128; and U.S. Pat. No. Des. 287,017.

Prior art roller grinders often suffer from frequent breakdowns in their drive systems. In particular, these prior art roller grinders experience stretch and breaking of the double sided V-belts, idler bearing failure, roll bearing failure, and roll shaft breakage. One reason for these breakdowns include extreme V-belt tension required to reduce belt slippage. As production demands on roller grinders increase, roller grinders must be run longer and harder. The extreme belt tension required for these demands places added strain on all parts of the drive system of the roller grinder. Eventually, the weakest parts of the drive system fail due to the increased strain placed on them. In particular, V-belt drives slip, stretch, and often break. Idler pulleys can go out of alignment and cause belt failure. Idler pulleys also have bearings which can also fail.

A roller grinder typically has top and bottom sets of rollers. The rollers in each set of rollers of a roller grinder need to be rotated in opposite directions in order to grind grain passing between the rollers of that set of rollers. Additionally, the rollers of the set need to be rotated at different speeds in order to effectuate grinding, rather than cracking, of feed passed between the rollers. Therefore, in prior art roller grinders double sided V-belt systems are used to achieve rotation of the rollers in different directions. However, V-belts are designed for high speed rotation because low speed rotation with V-belts causes slippage of the V-belts. As a result of the slippage, the V-belts suffer from increased wear and damage leading to breakdowns in the drive system of the roller grinders. Also because of the need to use V-belts, the shafts of the rollers must be made longer to load the V-belts thereon. As a result, the shafts of the rollers can break from overhung V-belt loading.

SUMMARY OF THE INVENTION

In view of the foregoing disadvantages inherent in the known types of roller grinder drive systems now present in the prior art, the present invention provides a new dual motor drive system construction wherein the same can be utilized for a roller grinder.

The general purpose of the present invention, which will be described subsequently in greater detail, is to provide a new dual motor drive system apparatus and method which has many of the advantages of the roller grinder drive systems mentioned heretofore and many novel features that result in a new dual motor drive system which is not anticipated, rendered obvious, suggested, or even implied by any of the prior art roller grinder drive systems, either alone or in any combination thereof.

To attain this, the present invention generally comprises a roller grinder having top and bottom sets of rollers extending between the sides of the roller grinder. Each set of rollers has a front roller and a back roller. Each roller of each set of rollers has a shaft having a pair of opposite ends. A first pulley is coupled to the end of the front roller of the top set of rollers extending from the first side of the roller grinder. A second pulley is coupled to the end of the front roller of the bottom set of rollers extending from the first side of the roller grinder. A third pulley is coupled to the end of the back roller of the top set of rollers extending from the second side of the roller grinder. A fourth pulley is coupled to the end of the back roller of the bottom set of rollers extending from the second side of the roller grinder. First and second motors are provided each having a rotating shaft extending therefrom. A first belt is looped around the first pulley, the second pulley, and the rotating shaft of the first motor such that the first belt is arranged in a generally triangular configuration. A second belt is looped around the third pulley, the fourth pulley and the rotating shaft of the second motor such that the second belt is arranged in a generally triangular configuration.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual motor drive system apparatus and method which has many of the advantages of the roller grinder drive systems mentioned heretofore and many novel features that result in a new dual motor drive system which is not anticipated, rendered obvious, suggested, or even implied by any of the prior art roller grinder drive systems, either alone or in any combination thereof.

It is another object of the present invention to provide a new dual motor drive system which may be easily and efficiently manufactured and marketed.

It is a further object of the present invention to provide a new dual motor drive system which is of a durable and reliable construction.

An even further object of the present invention is to provide a new dual motor drive system which is susceptible of a low cost of manufacture with regard to both materials and labor, and which accordingly is then susceptible of low prices of sale to the consuming public, thereby making such dual motor drive system economically available to the buying public.

Still yet another object of the present invention is to provide a new dual motor drive system which provides in the apparatuses and methods of the prior art some of the advantages thereof, while simultaneously overcoming some of the disadvantages normally associated therewith.

Still another object of the present invention is to provide a new dual motor drive system for a roller grinder.

Yet another object of the present invention is to provide a new dual motor drive system which includes a roller grinder having top and bottom sets of rollers extending between the sides of the roller grinder. Each set of rollers has a front roller and a back roller. Each roller of each set of rollers has a shaft having a pair of opposite ends. A first pulley is coupled to the end of the front roller of the top set of rollers extending from the first side of the roller grinder. A second pulley is coupled to the end of the front roller of the bottom set of rollers extending from the first side of the roller grinder. A third pulley is coupled to the end of the back roller of the top set of rollers extending from the second side of the roller grinder. A fourth pulley is coupled to the end of the back roller of the bottom set of rollers extending from the second side of the roller grinder. First and second motors are provided each having a rotating shaft extending therefrom. A first belt is looped around the first pulley, the second pulley, and the rotating shaft of the first motor such that the first belt is arranged in a generally triangular configuration. A second belt is looped around the third pulley, the fourth pulley and the rotating shaft of the second motor such that the second belt is arranged in a generally triangular configuration.

Still yet another object of the present invention is to provide a new dual motor drive system that reduces the chance of mechanical breakdowns from wear especially after prolonged and demanding use of the roller grinder. In particular, the dual motor drive system is designed to be more reliable because it has less pulleys, less belts, and no idler bearings to fail than prior art roller grinder drive systems. The present invention eliminates all double sided belts, eliminates all idler bearings, and reduces the shaft lengths of the rollers by about 50%.

Even still another object of the present invention is to provide a new dual motor drive system that increases the utilization of horsepower it provides. The present invention allows matching of the horsepower used between the top rollers of the roller grinder to the horsepower used between the bottom rollers of the roller grinder. This cannot be done in prior art single motor drive systems. This results in a better job of grinding by the rollers, more even roller wear, and less problems with the drive belts due to uneven horsepower division between the two (i.e., top and bottom) sets of rollers.

Still yet another object of the present invention is to provide a new dual motor drive system that allows the use of two smaller motors than the one large motor required in prior art roller grinders. This helps to reduce the cost of the present invention when compared to prior art roller grinders because generally, two smaller motors are less expensive than one larger motor.

Even still another object of the present invention is to provide a new dual motor drive system that helps increase the capacity of production of the roller grinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
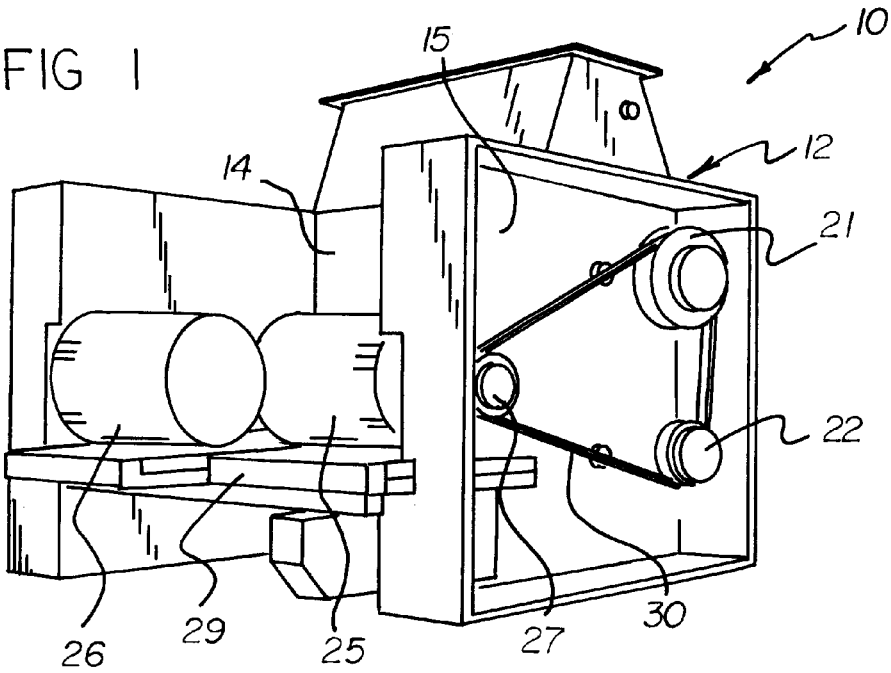
FIG. 1 is a schematic perspective view of the back of a new dual motor drive system according to the present invention.
Figure 2:
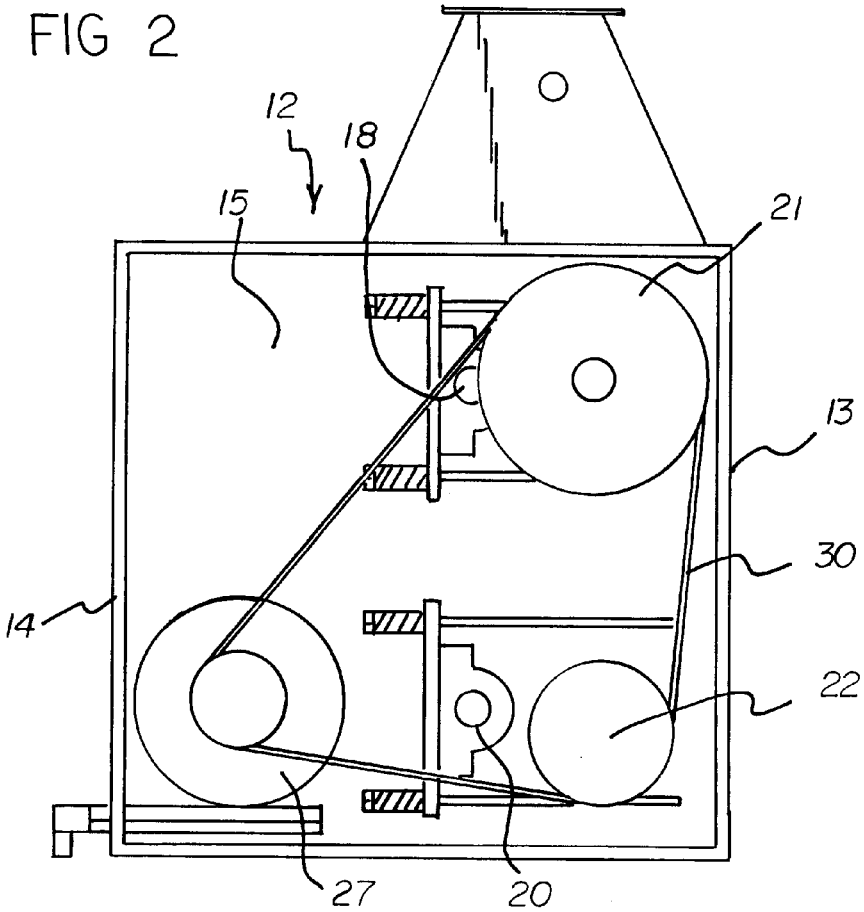
FIG. 2 is a schematic first side view of the present invention.
Figure 3:
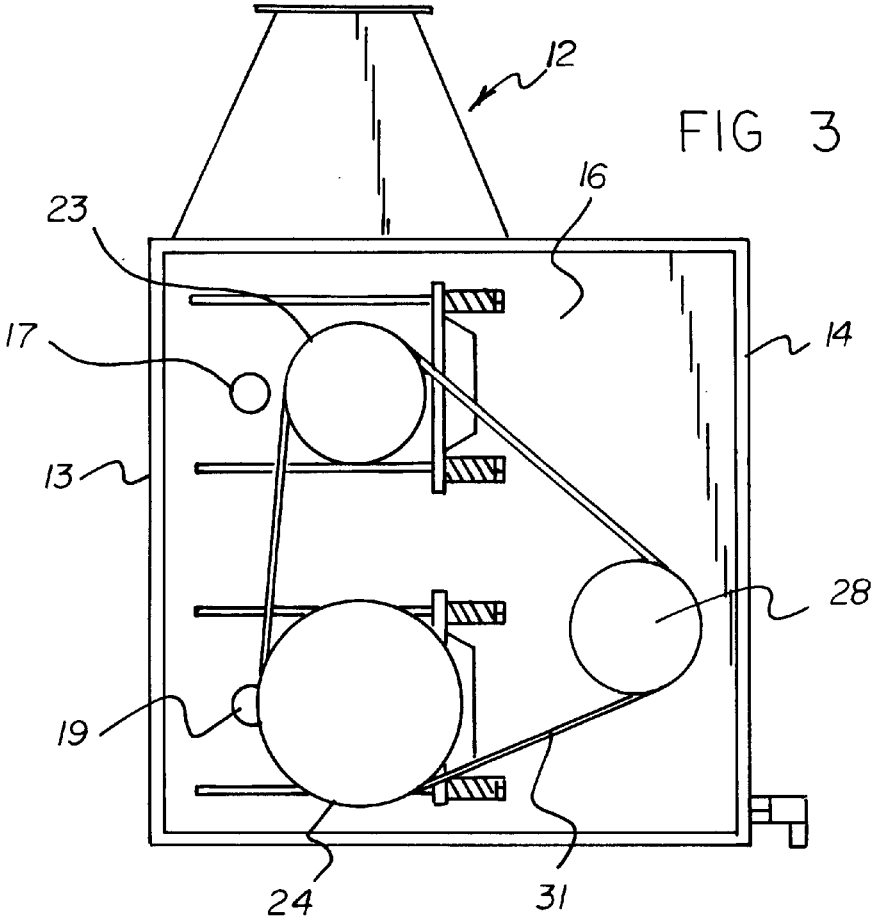
FIG. 3 is a schematic second side view of the present invention.
Figure 4:
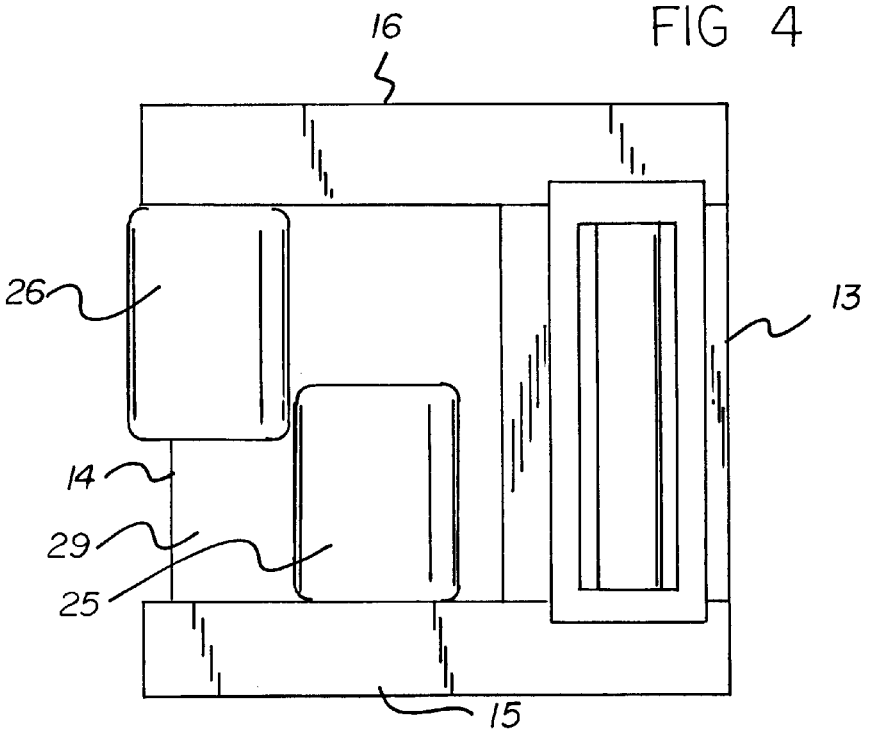
FIG. 4 is a schematic top side view of the present invention.

With reference now to the drawings, and in particular to FIGS. 1 through 4 thereof, a new dual motor drive system embodying the principles and concepts of the present invention and generally designated by the reference numeral 10 will be described.

As best illustrated in FIGS. I through 4, the dual motor drive system 10 generally comprises a roller grinder 12 having top and bottom sets of rollers extending between the sides 15,16 of the roller grinder 12. Each set of rollers has a front roller and a back roller. Each roller of each set of rollers has a shaft having a pair of opposite ends 17,18,19, 20. A first pulley 21 is coupled to the end of the front roller of the top set of rollers extending from the first side 15 of the roller grinder 12. A second pulley 22 is coupled to the end of the front roller of the bottom set of rollers extending from the first side 15 of the roller grinder 12. A third pulley 23 is coupled to the end of the back roller of the top set of rollers extending from the second side 16 of the roller grinder 12. A fourth pulley 24 is coupled to the end of the back roller of the bottom set of rollers extending from the second side 16 of the roller grinder 12. First and second motors 25,26 are provided each having a rotating shaft extending therefrom. A first belt 30 is looped around the first pulley 21, the second pulley 22, and the rotating shaft of the first motor 25 such that the first belt 30 is arranged in a generally triangular configuration. A second belt 31 is looped around the third pulley 23, the fourth pulley 24 and the rotating shaft of the second motor 26 such that the second belt 31 is arranged in a generally triangular configuration.

In closer detail, the roller grinder 12 has a front 13, a back 14, and a pair of spaced apart sides 15,16 extending between the front 13 and back 14 of the roller grinder 12. The roller grinder 12 also has top and bottom sets of rollers extending between the sides 15,16 of the roller grinder 12. Each set of rollers has a front roller and a back roller. Each roller of each set of rollers has a shaft having a pair of opposite ends 17,18,19,20. One end of the shaft of each of the rollers is outwardly extended through a first side 15 of the pair of sides 15,16 of the roller grinder 12, another end of the shaft of each of the rollers is outwardly extended through a second side 16 of the pair of sides 15,16 of the roller grinder 12. Each of the ends of the shafts of the rollers are rotatably mounted to the associated side of the roller grinder 12 to permit free rotation of each the roller about its shaft. A generally circular first pulley 21 is coupled to the end of the front roller of the top set of rollers extending from the first side 15 of the roller grinder 12. A generally circular second pulley 22 is coupled to the end of the front roller of the bottom set of rollers extending from the first side 15 of the roller grinder 12. A generally circular third pulley 23 is coupled to the end of the back roller of the top set of rollers extending from the second side 16 of the roller grinder 12. A generally circular fourth pulley 24 is coupled to the end of the back roller of the bottom set of rollers extending from the second side 16 of the roller grinder 12. Preferably, the first pulley has a diameter greater than the second pulley and the fourth pulley 24 has a diameter greater than the third pulley 23.

The system 10 also includes first and second motors 25,26. Each motor has a rotating shaft extending therefrom. Each of the rotating shafts has a drive pulley 27,28. Preferably, the back 14 of the roller grinder 12 has a platform 29 extending therefrom on which the motors 25,26 are mounted to. The rotating shaft of the first motor is positioned adjacent the first side 15 of the roller grinder 12 while the rotating shaft of the second motor is positioned adjacent the second side 16 of the roller grinder 12.

The first belt 30 is looped around the first pulley 21, the second pulley 22, and the drive pulley 27 of the first motor 25 such that the first belt 30 is arranged in a generally triangular configuration and such that rotation of the rotating shaft of the first motor rotates the front rollers. The second belt 31 is looped around the third pulley 23, the fourth pulley 24 and the drive pulley 28 the rotating shaft of the second motor 26 such that the second belt 31 is arranged in a generally triangular configuration and such that rotation of the rotating shaft of the first motor rotates the front rollers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A dual motor drive system for a roller grinder, said system comprising:

a roller grinder having a front, a back and a pair of sides extending between said front and back of said roller grinder;

said roller grinder having top and bottom sets of rollers extending between said sides of said roller grinder;

each set of rollers having a front roller and a back roller;

each roller of each set of rollers having a shaft having a pair of opposite ends one end of said shaft of each of said rollers being outwardly extended through a first side of said pair of sides of said roller grinder, another end of said shaft of each of said rollers being outwardly extended through a second side of said pair of sides of said roller grinder;

each of said ends of said shafts of said rollers being rotatably mounted to the associated side of said roller grinder to permit free rotation of each said roller about its shaft;

a first pulley being coupled to the end of said front roller of said top set of rollers extending from said first side of said roller grinder;

a second pulley being coupled to the end of said front roller of said bottom set of rollers extending from said first side of said roller grinder;

a third pulley being coupled to the end of said back roller of said top set of rollers extending from said second side of said roller grinder;

a fourth pulley being coupled to the end of said back roller of said bottom set of rollers extending from said second side of said roller grinder;

first and second motors, each motor having a rotating shaft extending therefrom;

said rotating shaft of said first motor being positioned adjacent said first side of said roller grinder, said rotating shaft of said second motor being positioned adjacent said second side of said roller grinder;

first and second flexible belts, said first and second flexible belts being formed out of a continuous endless strip;

said first belt being looped around said first pulley, said second pulley, and said rotating shaft of said first motor such that said first belt is arranged in a generally triangular configuration; and said second belt being looped around said third pulley, said fourth pulley and said rotating shaft of said second motor such that said second belt is arranged in a generally triangular configuration.

2. The system of claim 1, wherein each of said pulleys has a diameter, wherein said first pulley has a diameter greater than said second pulley, and wherein said fourth pulley has a diameter greater than said third pulley.

3. The system of claim 1, wherein each of said rotating shafts has a drive pulley, wherein said first flexible belt is looped around said first pulley, said second pulley, and said drive pulley of said rotating shaft of said first motor such that said first flexible belt is arranged in a generally triangular configuration, and wherein said second flexible belt is looped around said third pulley, said fourth pulley and said drive pulley said rotating shaft of said second motor such that said first flexible belt is arranged in a generally triangular configuration.

4. The system of claim 1, wherein said back of said roller grinder has a platform extending therefrom, said motors being mounted to said platform.

5. A roller grinder with a dual motor drive system, said roller grinder comprising:

a roller grinder housing having a front a back and a pair of sides extending between said front and back of, said roller grinder;

said roller grinder having top and bottom sets of rollers extending between said sides of said roller grinder;

each set of rollers having a front roller and a back roller;

each roller of each set of rollers having a shaft having a pair of opposite ends one end of said shaft of each of said rollers being outwardly extended through a first side of said pair of sides of said roller grinder, another end of said shaft of each of said rollers being outwardly extended through a second side of said pair of sides of said roller grinder;

each of said ends of said shafts of said rollers being rotatably mounted to the associated side of said roller grinder to permit free rotation of each said roller about its shaft;

a dual motor drive system for driving the rollers of said roller grinder, said system comprising:

a first pulley being coupled to the end of said front roller of said top set of rollers extending from said first side of said roller grinder;

a second pulley being coupled to the end of said front roller of said bottom set of rollers extending from said first side of said roller grinder;

a third pulley being coupled to the end of said back roller of said top set of rollers extending from said second side of said roller grinder;

a fourth pulley being coupled to the end of said back roller of said bottom set of rollers extending from said second side of said roller grinder;

first and second motors said first and second motors being mounted adjacent to the back of said housing of the roller grinder for minimizing the protrusion of the drive system beyond the first and second sides of said housing, each motor having a rotating shaft extending from the motor;

said rotating shaft of said first motor being positioned adjacent said first side of said roller grinder and extending, in a first direction, said rotating shaft of said second motor being positioned adjacent said second side of said roller grinder and extending in a second direction;

first and second flexible belts;

said first belt being looped around said first pulley, said second pulley, and said rotating shaft of said first adjacent to said first side; and said second belt being looped around said third pulley, said fourth pulley and said rotating shaft of said second motor adjacent to said second side.

6. The roller grinder of claim 5, additionally comprising a platform for supporting said first and second motors, the platform extending from the back of said housing of said roller grinder.

7. The roller grinder of claim 5, wherein the rotating shaft of said first motor is offset from the rotating shaft of said second motor for minimizing the protrusion of the rotating shafts of said first and second motors beyond the first and second sides of said housing.

8. The roller grinder of claim 5, wherein the first and second directions of said rotatable shafts are directly opposite directions.

9. The roller grinder of claim 5, wherein each of said pulleys has a diameter, wherein said first pulley has a diameter greater than said second pulley, and wherein said fourth pulley has a diameter greater than said third pulley for rotating the front and back rollers of each said set of rollers at different rotational speeds to produce a grinding of material passing between said front and back rollers of each said set of roller.

10. A dual motor drive system for rotating rollers of a roller grinder of the type including a roller grinder housing having a front, a back, and a pair of sides extending between the front and back, the system comprising:

a roller grinder having top and bottom sets of rollers for extending between the sides of the roller grinder housing, each set of rollers having a front roller and a back roller, each roller of each set of rollers having a shaft with a pair of opposite ends, one end of the shaft of each of the rollers being adapted for positioning adjacent a first side of the pair of sides of the roller grinder, another end of the shaft of each of the rollers being adapted for positioning adjacent a second side of the pair of sides of the roller grinder; and a drive system comprising:

a first pulley being coupled to the end of said front roller of said top set of rollers extending from said first side of said roller grinder;

a second pulley being coupled to the end of said front roller of said bottom set of rollers extending from said first side of said roller grinder;

a third pulley being coupled to the end of said back roller of said top set of rollers extending from said second side of said roller grinder;

a fourth pulley being coupled to the end of said back roller of said bottom set of rollers extending from said second side of said roller grinder;

first and second motors, said first and second motors being adapted for mounting adjacent to the back of said housing of the roller grinder for minimizing the protrusion of the drive system beyond the first and second sides of said housing, each motor having a rotating shaft extending from the motor;

said rotating shaft of said first motor being adapted for positioning adjacent to said first side of said roller grinder and extending in a first direction, said rotating shaft of said second motor being adapted for positioning adjacent to said second side of said roller grinder and extending in a second direction, said first and second directions being opposite to each other;

first and second flexible belts;

said first belt being looped around said first pulley, said second pulley, and said rotating shaft of said first motor; and said second belt being looped around said third pulley, said fourth pulley and said rotating shaft of said second motor.

11. The dual motor drive system of claim 10, additionally comprising a platform for supporting said first and second motors, the platform being adapted for extending from the back of said roller grinder housing.

12. The dual motor drive system of claim 10, wherein the rotating shaft of said first motor is offset from the rotating shaft of said second motor for minimizing the protrusion of the rotating shafts of said first and second motors beyond the first and second sides of said roller grinder housing.

* * * * *